United States Patent [19]

Deuring

[11] Patent Number: 4,826,180

[45] Date of Patent: May 2, 1989

[54] VALVE STEM SEALING ASSEMBLY

[75] Inventor: Hans Deuring, Burscheid, Fed. Rep. of Germany

[73] Assignee: Goetze AG, Burscheid, Fed. Rep. of Germany

[21] Appl. No.: 178,644

[22] Filed: Apr. 7, 1988

Related U.S. Application Data

[63] Continuation-in-part of Ser. No. 177,383, Apr. 4, 1988.

[30] Foreign Application Priority Data

Apr. 4, 1987 [DE] Fed. Rep. of Germany ..... 3711436

[51] Int. Cl.[4] ..... F16J 15/32; F01L 3/08

[52] U.S. Cl. ..... 277/9.5; 277/12; 277/152; 123/188 P

[58] Field of Search ..... 277/1, 9, 9.5, 11, 12, 277/152, 153; 123/188 P

[56] References Cited

U.S. PATENT DOCUMENTS

| | | | |
|---|---|---|---|
| 3,333,578 | 8/1967 | Muller | 123/188 P |
| 3,699,942 | 10/1972 | Moray | 123/188 P |
| 3,947,944 | 4/1976 | Washington | 277/1 X |
| 4,218,813 | 8/1980 | Cather | 277/11 X |
| 4,403,778 | 9/1983 | Shevokas et al. | 277/9.5 X |
| 4,531,483 | 7/1985 | Vossieck et al. | 123/188 P |

FOREIGN PATENT DOCUMENTS

| | | | |
|---|---|---|---|
| 0075702 | 4/1983 | European Pat. Off. | 123/188 P |
| 53-8414 | 1/1978 | Japan | 123/188 P |

*Primary Examiner*—Robert S. Ward
*Attorney, Agent, or Firm*—Spencer & Frank

[57] ABSTRACT

A valve stem sealing assembly includes a valve spring, a valve spring retainer, and a valve spring seal which is releasably connected either directly or indirectly to the valve spring retainer. Such a valve stem sealing assembly can be installed as a unit during mass production of engines. In one embodiment the valve spring retainer is provided with a sleeve which releasably supports the valve stem seal. Another embodiment includes a protection element on which the valve spring rests to keep it from digging into the metal of the engine. Both the protection element and the valve spring retainer are provided with sleeves in the second embodiment, and these sleeves are releasably connected. The valve stem seal is lodged in the sleeve of the protection element. In both embodiments the releasable connection, which may be provided by force-fitting one element into another, is released after installation of the assembly.

10 Claims, 1 Drawing Sheet

FIG. 1
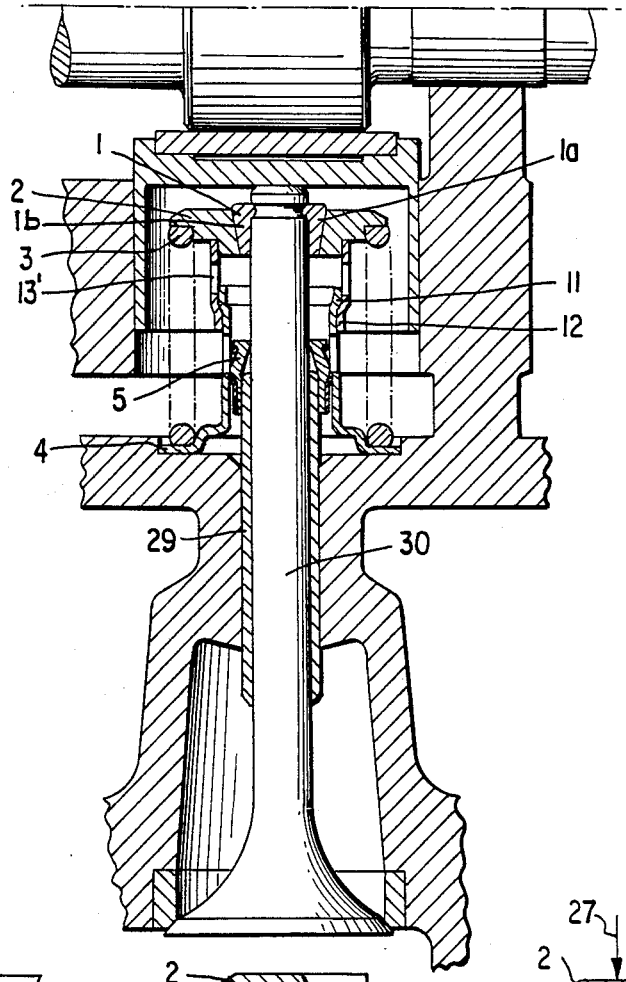
FIG. 5
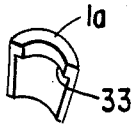
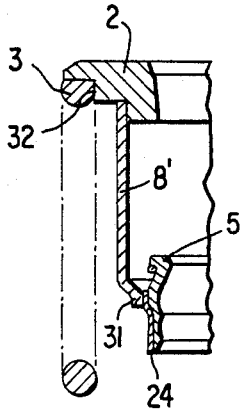
FIG. 4
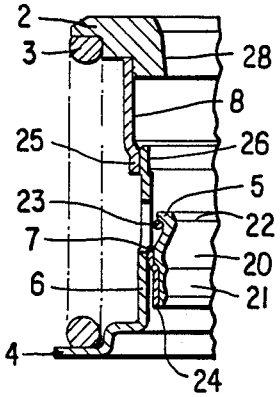
FIG. 2
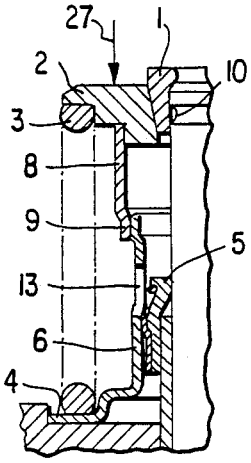
FIG. 3

VALVE STEM SEALING ASSEMBLY

CROSS-REFERENCE TO RELATED APPLICATION

This application is a continuation-in-part of applicant's co-pending application, Ser. No. 07/177,383, filed Apr. 4th, 1988.

BACKGROUND OF THE INVENTION

The present invention relates to an assembly for sealing valve stem, and more particularly to an assembly which includes a valve stem seal having a generally cylindrical elastic member with a sealing portion which slidably rests on the valve stem and with a connection portion which is mounted on the valve stem bushing, the valve stem seal additionally having a preferably metal stiffening ring which is vulcanized to the elastic member. Such a valve stem seal is typically used in conjunction with at least one spring which concentrically surrounds the valve stem, and a valve spring retainer which is connected with the valve stem.

U.S. Pat. No. 4,531,483 discloses a valve steam seal having a generally cylindrical elastic member with a sealing portion which slidably rests on the valve stem and with a connection portion which can be mounted on the valve steam bushing, the valve stem, seal additionally having a stiffening ring. With the aid of an assembly punch, the attachment portion of the valve stem seal is pressed onto the tubular valve stem bushing. To maintain a secure seat and proper operation, the valve stem bushing must be machined with precision; additionally, the valve stem seal requires an axial abutment to provide a neat seat at the valve stem bushing or at the cylinder head. Only after the valve stem seal has been properly installed can the remaining parts, such as a valve spring retainer, valve spring, and valve collet, be assembled.

In automatic fabrication, a separate manipulating machine is required for each part; additionally all individual parts must be stored separately.

SUMMARY OF THE INVENTION

It is an object of the present invention to facilitate the installation of valve stem seals during mass production, and to simultaneously reduce the installation costs for an assembly of valve actuating members in addition to a valve stem seal.

This object is accomplished by the present invention in that, before installation, the valve stem seal is releasably connected directly or indirectly with the valve spring retainer. In this way, the valve spring retainer is able to take over the function of the installation tool for the valve stem seal so that a separate installation punch is no longer required.

In accordance with the invention, the valve spring retainer is provided with a cylindrical sleeve which extends toward the valve stem seal. In one embodiment of the invention, the valve stem seal is force-fit into the sleeve of the valve spring retainer and is frictionally retained by the sleeve in a releasable manner. Thus it is possible to simultaneously press the valve stem seal onto the valve stem bushing during installation of the valve spring retainer.

If cylinder heads of light metal are employed, the prior art provides a protection element such as a washer between the valve spring and the light metal supporting face to prevent the valve spring from digging into the light metal. The protection element may either be connected with the valve stem seal by way of an axial extension or not. In accordance with a second embodiment of the invention, the protection element has a sleeve which receives the valve stem seal and which is releasably connected with the sleeve of the valve spring retainer. The sleeve of the protection element has a smaller diameter than the sleeve of the valve spring retainer and fits telescopically into the sleeve of the valve spring retainer.

In its end region facing the valve spring retainer, the sleeve of the protection element is bent outward toward the sleeve of the valve spring retainer. In order to realize a defined insertion depth for the valve stem seal, the sleeve of the protection element is provided with an axial abutment. To permit lubrication, the sleeves are provided with bores. The combination of valve stem seal and protection element provides the opportunity to omit precise machining of the seat for the valve stem seal.

With a valve stem sealing assembly in accordance with the present invention, the surfaces produced on sintered valve bushings and their dimensional tolerances are now entirely sufficient. The valve stem seal is no longer fixed by the valve bushing but by the valve spring retainer, namely over its sleeve. Additionally, the connection of the protection element and valve spring retainer makes it possible for all individual parts, such as the protection element, the valve spring retainer, the valve spring, and the valve stem seal, to be pushed onto the valve stem bushing as an installable unit, independently of whether the valve has already been installed or not.

BRIEF DESCRIPTION OF THE DRAWINGS

FIG. 1 is a sectional view showing a valve stem sealing assembly in accordance with a first embodiment of the present invention in its installed state.

FIG. 2 is a sectional view showing half of a valve stem sealing assembly in accordance with the first embodiment before installation.

FIG. 3 is a sectional view showing half of a valve stem sealing assembly in accordance with the first embodiment during installation.

FIG. 4 is a sectional view showing half of a valve stem sealing assembly in accordance with a second embodiment of the invention before installation.

FIG. 5 is a perspective view of one of paired identical elements of a collet employed in the valve stem sealing assembly.

DESCRIPTION OF THE PREFERRED EMBODIMENTS

FIG. 1 shows a valve stem sealing assembly in accordance with a first embodiment of the invention in its installed state in the cylinder head of an internal combustion engine. The assembly, which is installed in the engine as a unit, is composed of the parts necessary for valve operation, such as valve collet 1, valve spring retainer 2, valve spring 3 (only the first and last coils of spring 3 ar shown in the drawings, with dot-dash chain lines being used to schematically represent the interior spring coils), protection element 4, and valve stem seal 5. The first embodiment is particularly useful if the cylinder head is made from light metal, since protection element 4 keeps spring 3 from digging into the metal.

Turning next to FIG. 2, which shows half of a valve stem sealing assembly in accordance with the first embodiment before installation, the valve stem seal 5 includes a generally cylindrical elastic member 20 having a connection portion 21 and a sealing portion 22. A metal sealing ring 23 is attached to the sealing portion 22 and a metal reinforcing cylinder 24 is attached to the connection portion 21. Protection element 4 has a sleeve 6 which is provided with an annular abutment 7. Seal 5 is pressed into sleeve 6 and is frictionally retained therein. This is not a releasable connection; instead, annular abutment 7 determines the insertion depth at which seal 5 is retained by engaging the upper end of reinforcing cylinder 24.

Abutment 7 may be formed, for example, by radial bending of sleeve 6 to provide a construction as shown, or by making a ring of triangular cuts (not illustrated) in sleeve 6 and bending the resulting points inward. Valve spring retainer 2 is provided with an attached sleeve 8 having an annular constricted region 25 at the outer end thereof. The outer end of sleeve 6 has an annular enlarged region 26.

Before the valve stem sealing assembly is installed in the cylinder head, sleeve 6 is connected with the sleeve 8 of valve spring retainer 2 in a force-fit and releasable manner, with valve spring 3 being clamped in between protection element 4 and valve spring retainer 2. This releasable connection between sleeves 6 and 8 is accomplished by wedging enlarged region 26 into constricted region 25 to bring these regions into tight frictional engagement.

The combination of valve stem seal 5 and the valve actuating members (e.g., spring retainer 2, spring 3, and protection element 4) before installation in the cylinder head permits the valve stem sealing assembly to be installed as a unit in the cylinder head with only one automatic machine operation. To make the valve stem sealing assembly operational, it is merely necessary to axially stress valve spring retainer 2 as shown schematically by arrow 27 in FIG. 3. In this way, the pressure seat 9 between regions 25 and 26 is released, and the previously inserted valve collet 1 drops into valve head groove 10. The outer surface of collet 1 is slightly conical and, similarly, the bore 28 (FIG. 2) in valve spring retainer 2 is slightly conical, so that collet 1 is effectively locked to valve spring retainer 2 during operation of the engine. The sleeves 8 and 6 are displaced axially with respect to one another to such an extent during installation that their respective wider and smaller cross sections 11 and 12 (FIG. 1) no longer contact one another at regions 25 and 26. This ensures the free mobility of the individual parts in the installed state. It will be apparent that, before the separation of regions 25 and 26, the installation pressure indicated by arrow 27 is also transferred by way of abutment 7 to the reinforcing cylinder 24 of valve stem seal 5. This forces attachment portion 21 over the valve stem bushing 29 (FIG. 1). It will also be apparent that, in the installed state, sealing portion 22 slidably rests against valve stem 30 (FIG. 1) as it reciprocates. Bore 13 and 13' (see FIGS. 1 and 3) permit lubrication to reach valve stem 30 and valve stem seal 5.

FIG. 4 is a sectional view illustrating half of a valve stem sealing assembly in accordance with a second embodiment of the invention. The second embodiment, like the first, is installable as a unit, but unlike the first embodiment the second embodiment does not include a protection element. In the second embodiment, the valve spring retainer 2 has a sleeve 8' that is longer than the sleeve 8 of the first embodiment. The reinforcing cylinder 24 of the valve stem seal 5 is releasably force-fit to the sleeve 8' at the annular constricted region 31. The diameter of shoulder 32 of retainer 2 is slightly larger than the diameter of the upper coil of spring 3 in its un-stressed state, so that spring 3 loosely grips retainer 2 and can be moved into position for installation along with retainer 2. Alternatively, spring 3 may be spot welded to valve spring retainer 2 to prevent it from being dislodged prior to installation in the engine.

In order to fix retainer 2 to the valve stem 30, a dividable collet 1 is employed which is coaxially disposed between valve stem and retainer 2 and comprises two identical elements (**1*a*, 1*b***).

As is seen from FIG. 5, each element **1*a* comprises a semicylindrical portion having a tapered cylindrical outer surface. The cylindrical inner surface of the element 1*a* is formed with a radially inwardly ridge portion 33. As seen from FIG. 1 the retainer 2 is formed with a central bore of which surface is tapered and shaped to match with the tapered surface of the collet 1**.

It will be understood that the above description of the present invention is susceptible to various modifications, changes and adaptations, and the same are intended to be comprehended within the meaning and range of equivalents of the appended claims.

What I claim is:

1. A valve stem sealing assembly for sealing a valve stem which extends through a valve stem bushing, comprising:

a valve stem seal which includes an elastic member having a sealing portion to rest on the valve stem and having an attachment portion to fit onto the valve stem bushing;

a valve spring;

a valve spring retainer to hold the valve spring concentrically around the valve stem; and means for releasably connecting the valve stem seal to the valve spring retainer before the valve stem sealing assembly is installed to seal the valve stem.

2. The assembly of claim 1, wherein the means for releasably connecting comprises a generally cylindrical sleeve which is affixed to the valve spring retainer and which extends toward the valve stem seal.

3. The assembly of claim 2, wherein the sleeve has a first portion with a first diameter and a second portion with a second diameter which is smaller than the first diameter, the second portion of the sleeve being adjacent the attachment portion of the elastic member.

4. The assembly of claim 3, wherein the valve spring seal is releasably force-fit into the second portion of the sleeve.

5. The assembly of claim 2, further comprising an annular protection element with a central opening for passage of the valve stem, the valve spring being disposed between the protection element and the valve spring retainer, and wherein the means for releasably connecting further comprises a generally cylindrical another sleeve which is affixed to the protection element and which extends toward the valve spring retainer, the valve stem seal being received in the another sleeve, the sleeve and another sleeve being releasably connected.

6. The assembly of claim 5, wherein the another sleeve has an end which faces the valve spring retainer, the another sleeve having a bent region adjacent the end, the bent region extending toward the sleeve which is affixed to the valve spring retainer.

7. The assembly of claim 6 wherein the another sleeve additionally has an abutment to receive the valve spring seal.

8. The assembly of claim 7, wherein the sleeve and another sleeve have radial bores.

9. The assembly of claim 1, wherein the valve stem seal further comprises a reinforcing ring which is connected to the elastic member by vulcanization.

10. The assembly of claim 9, wherein the reinforcing ring is metal.

* * * * *